United States Patent [19]

Fontana

[11] 4,328,841

[45] May 11, 1982

[54] FABRIC WITH DOUBLE LENO WARP THREADS

[76] Inventor: Giulio Fontana, Via Carminati de Brambilla 43, Casatenovo (Como), Italy

[21] Appl. No.: 139,136

[22] Filed: Apr. 10, 1980

[30] Foreign Application Priority Data

Apr. 12, 1979 [IT] Italy ..... 21808 A/79

[51] Int. Cl.[3] ..... D03D 19/00

[52] U.S. Cl. ..... 139/419; 139/421

[58] Field of Search ..... 139/419, 421, 422, 423; 428/230, 231; 128/163, 164, 165, 166.5

[56] References Cited

U.S. PATENT DOCUMENTS 1,950,559 3/1934 Kendrick ..... 139/419

FOREIGN PATENT DOCUMENTS 629892 5/1936 Fed. Rep. of Germany ..... 139/419

680530 8/1939 Fed. Rep. of Germany ..... 139/419

739074 11/1937 France ..... 139/419

*Primary Examiner*—Henry Jaudon

*Attorney, Agent, or Firm*—Michael N. Meller; Anthony H. Handal

[57] ABSTRACT

A fabric with double leno warp threads having a warp comprising threads of elastomeric material, particularly adapted for the manufacture of elastic bands and body-belts. In such a fabric the threads of elastomeric material are firmly bound to the other threads of the fabric by double leno warp threads avoiding curliness and allowing the fabric to retain a high softness even after many washing operations.

5 Claims, 2 Drawing Figures

FABRIC WITH DOUBLE LENO WARP THREADS

This invention relates to a fabric with double leno warp threads, and more particularly to an elastic fabric with double leno warp threads.

The elastic fabrics have a warp comprising threads of elastomeric material or rubber and are particularly used for the manufacture of elastic bands which are often designed for wear at direct contact with the skin.

The prior art elastic bands (and accordingly the fabrics comprising the same) have the disadvantage of being comparatively rough or coarse (as a result of the type of weave by which the elastomeric threads are bound to the weft threads) and of not having a sufficiently extended dimensional stability, which impairs the life thereof.

It is an object of the present invention to provide an elastic fabric which is very soft to the touch.

It is another object of the invention to provide an elastic fabric in which the threads of elastomeric material are firmly bound to the other threads of the fabric, avoiding curliness and allowing the fabric to retian a high softness even after many washing operations.

These and still further objects are accomplished in a fabric comprising a warp including rubber or elastomeric material threads and binding threads, and a weft comprising upper weft threads and lower weft threads positioned above and respectively below the warp rubber threads to which they are substantially perpendicular, characterized in that the weft threads are bound to one another and to each of the rubber threads by a lower leno warp thread and by an upper leno warp thread extending through one half turn about each rubber thread between one binding and the next, with each of the lower turn binding threads passing over a first lower weft thread, then under and at the other side of the rubber thread with which it is associated, under a first upper weft thread, over a second lower weft thread, a second upper weft thread and a third lower weft thread, then again under and at the first side of the rubber thread, under a third upper weft thread, then over a fourth lower weft thread, a fourth upper weft thread, and finally again over a new lower weft thread and so on, and with each upper turn binding thread passing over the first lower weft thread, over and at the other side of the rubber thread, under the first upper weft thread, under the second lower weft thread, under the second upper weft thread, over and again at the first side of the rubber thread, over the third lower weft thread, under the third upper weft thread, under the fourth lower weft thread, under the fourth upper weft thread and again over the next lower weft thread and rubber thread and so on.

Figure 1:
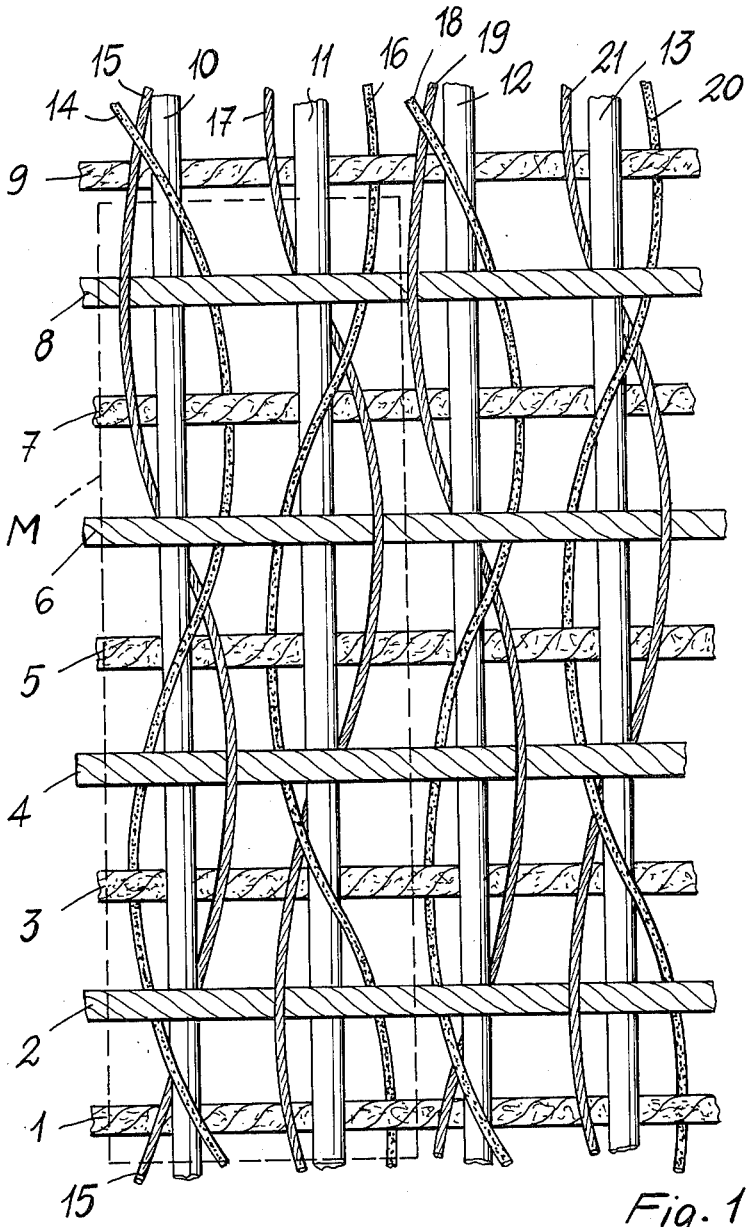
Figure 2:
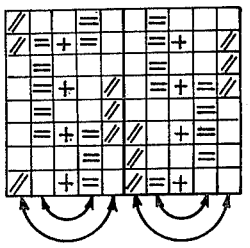

In order that the structure and features of a fabric according to the invention be more clearly understood, a preferred embodiment given by mere way of unrestrictive example will now be described with reference to the accompanying drawing, in which:

FIG. 1 is a plan view on a very large scale of the fabric and with the stitches exagerately spaced apart from one another, so that the paths for the various threads can be easily located; and FIG. 2 is a view schematically showing the weave of the fabric.

Referring first to FIG. 1, in which the outline is given for a fabric, the warp of which comprises threads of rubber or elastomeric material (10, 11, 12 and 13), which in the case are covered with a yarn having the purpose of restricting the elongation, promoting the dyeing, increasing the strength and obstructing the sliding thereof upon fabric completion, lower turn binding threads (15, 17, 19 and 21) and upper turn binding threads (14, 16, 18 and 20); and the weft of which comprises the lower weft threads (1, 3, 5, 7 and 9) and the upper weft threads (2, 4, 6 and 8). The weft threads are parallel with one another and perpendicular to the warp rubber threads, above which all of the upper weft threads are distributed, while the lower weft threads are located therebelow.

In order to understand the fabric structure, let us consider the weave formed with the weft threads and rubber thread 10 by the binding threads 14 and 15. As it will be appreciated from FIG. 1, the lower turn binding thread 15 first passes over the thread 1, then under and at the other side of the rubber thread 10, under the thread 2, over the threads 3, 4 and 5, then again under and at the first side of the rubber thread 10, under the thread 6, over the threads 7 and 8, and finally again over the next lower weft thread 9 to repeat the described weave.

The upper turn binding thread passes over the thread 1, over and at the other side of the rubber thread 10, over the threads 2, 3 and 4, over and again at the first side of the rubber thread 10 and over the thread 5, under the threads 6, 7 and 8, and finally again over the rubber thread 10 and the next lower weft thread 9.

From FIG. 1 it will be seen the weave of the binding threads is reproduced on a rubber thread adjacent to the rubber thread being considered, but displaced by two weft threads in the fabric weave. For example, considering the rubber thread 10, while the lower turn thread 15 binds the weft thread 4, the lower turn thread 17 relative to the rubber thread 11 binds the weft thread 6, which is the second weft thread next to thread 4. This type of weave is repeated throughout the fabric according to a constant module, which is that enclosed within the rectangle shown by dashed line in FIG. 1 and designated by letter M.

As it will be appreciated from the described structure, the weft threads (1–9) are bound to one another and to the rubber or elastomer warp threads by a lower turn binding thread and by an upper turn binding thread operating as leno warp threads moving through one half turn about each of the rubber threads between one binding with the weft and the next.

This characteristic causes a fabric thus manufactured to be highly soft and bound and further ensures a quite perfect blocking of the elastomer threads to the fabric, avoiding any curliness thereof and assuring an excellent dimensional stability to the fabric.

The softness of the fabric is assisted in that the binding locations for the weft threads (that is, the locations where the upper weft threads are bound by the lower turn binding threads and where the lower weft threads are bound by the upper turn binding threads) are not aligned to one another, and in that both the preceding weft thread and the weft thread next to a weft thread (on the same side or face of the fabric) at the location where it is outward stepped over by a binding thread, form bridles, that is elongated bridges having some freedom of movement and accordingly tending to cover and overlap the binding location where the intermediate weft thread is retained inwardly of the fabric by the binding thread which, as described in the following, is of a smaller cross-section than that of the weft threads.

For example, at one side of the binding location or stitch formed by the thread 19 on the weft thread 4, there is a bridle comprising the weft thread 2 (which is bound by the threads 17 and 21), while at the other side the bridle comprising the weft thread 6 is determined by the locations or stitches where it is bound by said above considered threads 17 and 21. Owing to the described structure, all of the threads comprising the fabric are firmly bound, which allows the fabric to take and retain upon washing a unique softness, whereas the elastomer warp threads tend to take and retain a substantially rectilinear longitudinal attitute.

Preferably, the weft threads are all identical to one another, for example comprising a mixing or blending of 50% wool threads and 50% chlorofiber threads, or are entirely threads of wood or other material.

For example, the binding threads are of polyester. Should the fabric be used for the manufacture of elastic bands, the rubber or elastomer threads may have, for example, 840 denier and be covered with viscose threads, the binding threads may be two-terminal texturized 150 denier polyester threads, while the warp threads may comprise 1/28 wool and chlorofiber threads in a 50% mixing or blending. For the weaving of such a fabric, a standard one-shuttle or one-filler loom may be used, conventionally moving the heddles for the manufacture of leno warp thread fabrics and for the weft setting two polyester threads between each pair of adjacent rubber threads.

The scheme for the weave of the fabric described in connection with FIG. 1 is shown in FIG. 2. In the outline fabric, the warp comprises rubber or elastomer threads (designated by the reference symbol +), upper turn binding threads (designated by the reference symbol =) and lower turn binding threads (designated by the reference symbol //). On the other hand, the weft comprises 4 wool and chlorofiber threads.

What I claim is:

1. A fabric with double leno warp threads comprising a warp including rubbery material threads and binding threads, and a weft comprising upper weft threads and lower weft threads positioned above and respectively below the rubbery warp threads, to which they are substantially perpendicular, wherein the weft threads are bound to one another and to each of the rubbery threads by a lower leno warp thread and by an upper leno warp thread extending through one half turn about each rubbery thread between one binding with the weft and the next, with each of the lower turn binding threads passing over a first lower weft thread, then under and at the other side of the rubbery thread with which it is associated, under a first upper weft thread, over a second lower weft thread, a second upper weft thread and a third lower weft thread, then again under and at the first side of the rubbery thread, under a third upper weft thread, then over a fourth lower weft thread, a fourth upper weft thread and finally again over a new lower weft thread and so on, and with each upper turn binding thread passing over the first lower weft thread, over and at the other side over the rubbery thread, under the first upper weft thread, under the second lower weft thread, under the second upper weft thread, over and again at the first side of the rubbery thread, over the third lower weft thread, under the third upper weft thread, under the fourth lower weft thread, under the fourth upper weft thread, and again over the next lower weft thread and rubbery thread and so on to complete said fabric.

2. A fabric with double leno warp threads as in claim 1, wherein the interweaving of the binding threads is repeated on a rubbery thread adjacent a given rubbery thread, displaced by two weft threads in the fabric weave.

3. A fabric with double leno warp threads as in claim 2, wherein the weft threads are all identical to one another.

4. A fabric with double leno warp threads as in claim 1, wherein the weft threads are all identical to one another.

5. A fabric with double leno warp threads as in claim 4, wherein said weft threads comprise a mixing of 50% wool threads and 50% chlorofiber threads.

* * * * *